United States Patent [19]

Roach et al.

[11] Patent Number: 5,003,907

[45] Date of Patent: Apr. 2, 1991

[54] BOAT HOOK

[76] Inventors: John E. Roach, 5582 N. Range Rd., LaPorte, Ind. 46352; Kim S. Parrette, 779 E. Lake Mitchell Dr., Cadillac, Mich. 49601

[21] Appl. No.: 196,665

[22] Filed: May 20, 1988

[51] Int. Cl.[5] ..... B63B 21/04

[52] U.S. Cl. ..... 114/221 R; 294/19.1; 114/230

[58] Field of Search ..... 114/221 R, 230; 294/19.1, 19.3; 119/151, 153, 96

[56] References Cited

U.S. PATENT DOCUMENTS

| | | | |
|---|---|---|---|
| 3,048,139 | 8/1962 | Dockett | 114/221 R |
| 3,841,685 | 10/1974 | Kolodziej | 294/19.1 |
| 3,861,346 | 1/1975 | Pina | 114/221 R |
| 3,878,808 | 4/1975 | Mock, Jr. | 114/221 R |
| 3,945,335 | 3/1976 | Kratz | 114/221 R |
| 4,519,643 | 5/1985 | Harris | 114/221 R |
| 4,635,986 | 1/1987 | Johns | 114/221 R |

*Primary Examiner*—Joseph F. Peters, Jr.
*Assistant Examiner*—Edwin L. Swinehart
*Attorney, Agent, or Firm*—James D. Hall

[57] ABSTRACT

A mooring and maneuvering device which includes an elongated rigid pole having an improved boat hook at the distal end thereof and further including a flexible loop movable from an operative position to facilitate the securing of said device to a mooring post and an inoperative position wherein said loop is pivoted back upon and secured to said pole to permit the use of the device for other purposes.

3 Claims, 3 Drawing Sheets

BOAT HOOK

FIELD OF THE INVENTION

This invention relates to improvements in mooring and maneuvering devices which aid in the docking of boats or in the maneuvering of such boats when in tight surroundings.

BACKGROUND OF THE INVENTION

The mooring or docking of boats requires a high degree of proficiency, especially as the size of the boat increases and when it is desired to maneuver the boat into a slip which is only slightly wider and longer than the boat itself. Additionally, it is extremely critical to be able to maneuver a boat in a crowded marina or boat dock avoiding damage to the user's boat as well as to those in the same marina or area.

It is essentially for the above reasons that boat hooks were contrived. The boat hook generally includes, and has included without material change over years of use, an elongated pole having a handle end and a hooked distal end. The hooked end is utilized for a number of purposes including, but not limited to, the retrieval of dropped objects and as an aid in the securing of the boat to a dock. In the latter instance, the boat hook may be used to place the loop of a line over a mooring post, a dock cleat or another type of mooring means when docking, or to remove such a line when disembarking.

Needles to say, a critical part of docking is securing the looped end of a line to the mooring means. As a consequence, there have been a great number of inventions, patented and unpatented, aimed at the placement of the loop end over the mooring means. Almost all of these prior art devices include a rather complex attachment to the distal end of the standard boat hook. These complicated attachments handle or utilize the line in some fashion.

The present invention is of simplified construction and greatly facilitates the docking maneuver. A further advantage of the present invention is that it provides an improvement in the distal end of the boat hook which permits the user to maneuver the boat relative to the docking area by the applicaton of pushing or pulling forces. The present invention provides a greater degree of safety and convenience as compared to prior devices.

SUMMARY OF THE INVENTION

The present invention is herein shown and described in combination with an improved hook end. The pole itself is not a limiting part of the invention and may be of conventional structure. The pole is preferably of a current state of the art tubular telescoping construction but may be of any conventional design. The distal end of the pole is provided with an improved boat hook, which may be machined or cast as a unitary structure and which may be composed of metallic or suitable plastic material. The hook portion is generally Y-shaped and suitably attached to the distal end of the pole. The shape is of such a design as to facilitate the maneuverability about a mooring post or similar structure, in that it provides a superior surface for the exertion a pushing force against any surface.

Prior boat hooks had a generally pointed distal end. Such a structure was difficult to use because, when the surface against which the user was pushing was cylindrical or very small, the pointed end had a natural tendency to slip off. In addition, the present invention provides a flexible loop, which is preferably semi-rigid. The semi-rigid material is preferably a semi-springable material which is covered with a protective layer of plastic or rubber-like coating.

The flexible loop may be at any desired length sufficient to pass around a mooring post. These loop ends are hingedly or pivotally attached either to the base portion of the Y-shaped attachment or to the pole proximate to such distal end. The loop may be pivoted into an extended position to facilitate the snaring of a mooring device (or to serve as a grasping means to someone on the dock) or into a storage position where at it is secured to the pole, thereby permitting the boat hook to be used in conventional fashion.

BRIEF DESCRIPTION OF THE DRAWINGS

The foregoing and other advantages of the invention will become apparent from the following description of the preferred embodiment thereof, as illustrated in the accompanying drawings, wherein like reference numerals refer to like elements in the several figures and in which.

DETAILED DESCRIPTION OF THE PREFERRED EMBODIMENT

Figure 1:
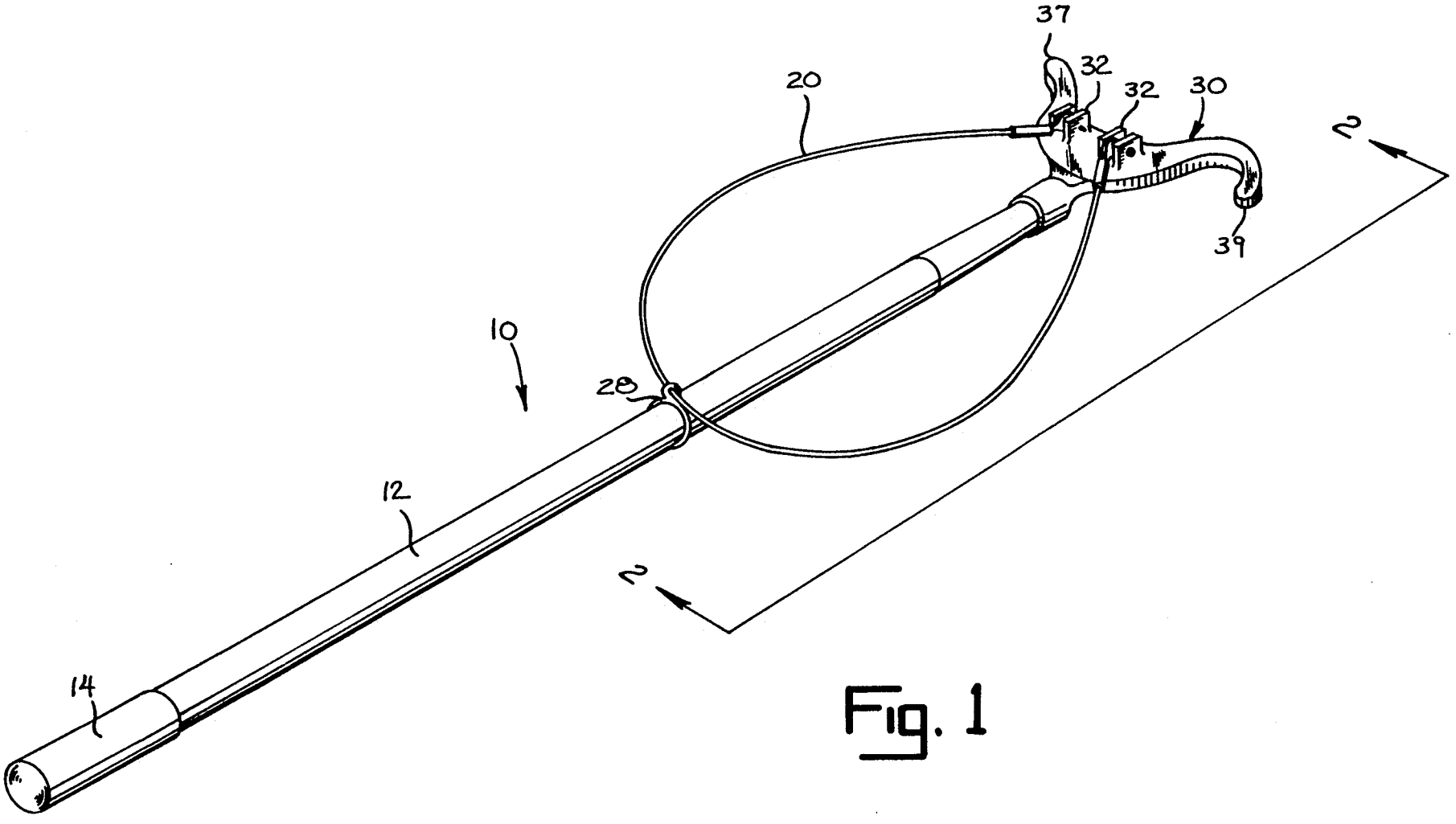
FIG. 1 is a perspective view of the device with the loop in its stored condition.

Referring generally to the drawings, the loop is shown in an inoperative or stored position, but it should be obvious that the loop is merely detached from its clipped stored position and pivoted into its extended position for use in grasping a mooring post or other docking means.

The invention will be hereinafter referred to, for sake of expediency, as a mooring device, but it will be understood, as will be explained, that the invention serves as a maneuvering aid and has many other utilitarian purposes.

The mooring device 10 includes three principal parts, an elongated, rigid pole 12 having a handle 14 at one end, a maneuvering attachment 30 at the distal end thereof, and a loop 20 for snaring a mooring post or the like (not shown). Pole 12 is depicted in its simplest form, so as not to complicate the illustration of, nor to detract from, the invention, but it will be understood that it may be of a telescoping type, fixed length, of any generally available and conventional structure and material. It may, of course, be constructed so that, as in the case of other such similar devices, it will float for ease of retrieval in the event that it is dropped into the water.

Loop 20 of sufficient length that it may be, when in the extened mode, slipped over a mooring post or dock cleat (neither shown). To each end 22 of loop 20 are attached elongated flat projections, commonly referred to as lugs 24, each having an eyelet 26. Complementary thereto, and extending outwardly from maneuvering attachment 30, are two pair of ears 32, each slotted so to receive lugs 24 in pivotal or hinged relationship.

Each pair of ears 32 includes a transverse bore 33. A loop eyelet 26 is inserted within the slot in an ear 32 and a screw 34 is turned into bore 33 and through the eyelet about which loop 20 pivots. Screws 34 are illustrated, but it will be obvious that any type of pin or blot may be utilized so long as it performs the desired function.

Figure 2:
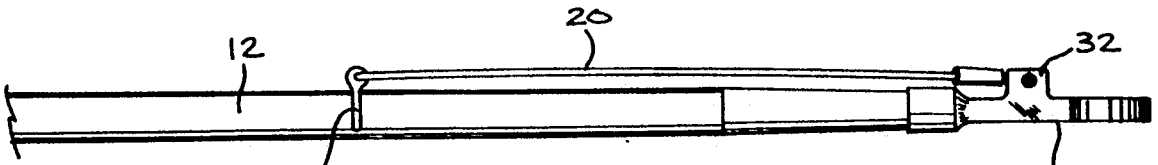
FIG. 2 is a fragmentary side elevation view, seen from line 2—2 of FIG. 1.
Figure 3:
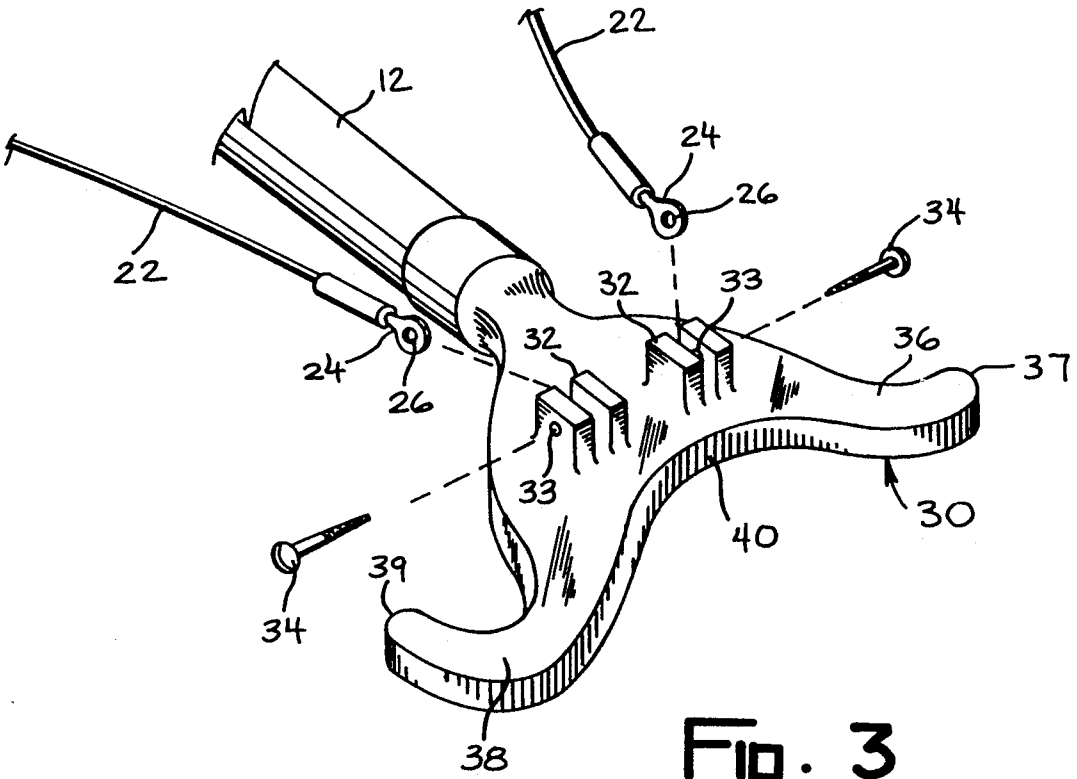
FIG. 3 is a fragmentary, semi-exploded view depicting the attachment of the ends of the flexible loop to the distal end of the pole.
Figure 4:
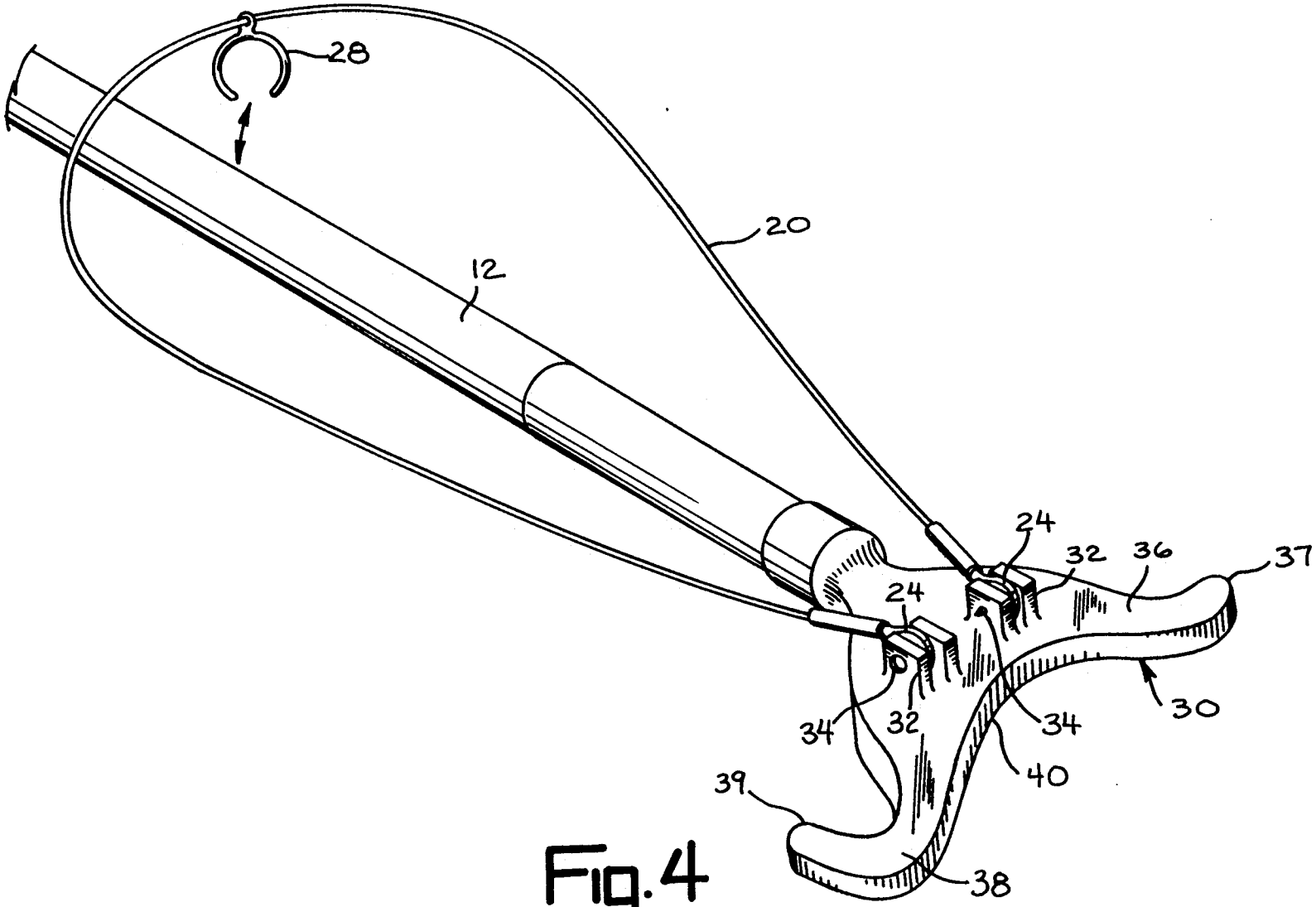
FIG. 4 is a fragmentary perspective view depicting the attachment of the closed ens of the flexible loop to the pole.

Loop 20 further includes means to releasably attach the closed end thereof to pole 12. Such means is herein illustrated as a flexible clip 28 carried by loop 20. When so attached as seen in FIG. 2, loop 20 is in an inoperative condition, which permits mooring device 10 to be stored or to be used for maneuvering.

Maneuvering attachment 30 is attached to the distal end of pole 12 and is of generally Y-shaped and flattened configuration. Legs 36, 38 extend rectilinearly and transversely relative to the longitudinal axis of pole 2 and are of slightly different shape. Leg 36 terminates in a rounded end 37 for fending off, while leg 38 terminates in an inturned end 39 for hooking.

Edge 40 of maneuvering attachment 30, between legs 36, 38, is formed concave toward the direction of the base of said maneuvering attachment 30 and pole 12. Maneuvering attachment 30 is therefore of a cradled shape at edge 40 which facilitates the pushing by a user of mooring device 10 against any fixed object, be it a mooring or docking means, another boat, a tree or other object in or the shore of the water. Conventional boat hooks generally have a shaped attachment which is pointed at the end and which includes a curved hook portion. When mooring or fending off an object or another boat, careless use may cause injury to another person or to another boat. The re-designed maneuvering attachment 30 of this invention not only makes it far easier to position mooring device 10 against any other object without slippage, but is safer for individuals.

With the current invention, the user of mooring device 10 disengages flexible loop 20 from pole 12 and pivots the loop so that the loop is in its extended position. The user has two choices, if he decides to utilize maneuvering attachment 20 to stop the progress of the boat, the flexibility of loop 20 permits him to press attachment 30 at edge 40 against mooring means. If the mooring means is a post, the shape of attachment 30 ensures against slipping. In the alternative, assuming again that the mooring means is a pole, the user may slip loop 20 over the post, thereby capturing it, and push or pull to effect the stopping or slowing of the boat.

In addition to the uses described above, the mooring device of this invention may be used in any manner that a conventional boat hook may be used, except that it may be used more efficiently and safely.

Although the invention has been described in specific terms, it will be obvious and should be understood that various changes may be made without departing from the sprit and scope of the invention as claimed.

We claim:

1. A mooring and maneuvering device comprising:

a rigid, elongated pole member having a handle end and a distal end, said distal end having a hook carrying means extending transversely from the longitudinal axis of said pole;

said hook carrying means being generally Y-shaped with projecting legs, one leg of said hook carrying means being elongated and turned outwardly back upon its self to form a hook; and said hook carrying means having an edge portion extending between its said legs, said edge portion being concave to form a cradle, said distal end carrying a flexible loop means for engagement with a mooring device, said loop means including opposite ends, said loop means ends being pivotally connected to said distal end with said loop means being extensible from said pole member.

2. The device of claim 1 wherein said loop means comprises a springable wire material.

3. The device of claim 1 wherein one of said pole and loop means including releaseable attachment means for securing the loop means between its said ends to the pole.

* * * * *